US006295026B1

(12) United States Patent
Chen et al.

(10) Patent No.: US 6,295,026 B1
(45) Date of Patent: Sep. 25, 2001

(54) ENHANCED DIRECT RADIATING ARRAY

(75) Inventors: Chun-Hong H. Chen, Torrance; Barry R. Allen, Redondo Beach; Kenneth T. Yano, Torrance; Mark Kintis, Manhattan Beach; Steven S. Kuo, Torrance, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/443,526

(22) Filed: Nov. 19, 1999

(51) Int. Cl.[7] ..... H01Q 3/22

(52) U.S. Cl. ..... 342/368; 342/372; 342/374

(58) Field of Search ..... 342/81, 154, 368, 342/372, 373, 374

(56) References Cited

U.S. PATENT DOCUMENTS

| | | | | |
|---|---|---|---|---|
| 4,633,256 | * | 12/1986 | Chadwick | 342/368 |
| 4,814,775 | * | 3/1989 | Raab et al. | 342/373 |
| 5,305,009 | * | 4/1994 | Goutzoulis et al. | 342/157 |
| 5,374,935 | * | 12/1994 | Forrest | 342/368 |
| 5,541,607 | * | 7/1996 | Reinhardt | 342/372 |
| 5,684,491 | * | 11/1997 | Newman et al. | 342/374 |
| 5,889,494 | * | 3/1999 | Reudink et al. | 342/373 |
| 6,005,515 | * | 12/1999 | Allen et al. | 342/374 |
| 6,070,090 | * | 5/2000 | Feuerstein | 455/561 |

* cited by examiner

*Primary Examiner*—Dao Phan
(74) *Attorney, Agent, or Firm*—Michael S. Yatsko

(57) ABSTRACT

An apparatus (800) and method (1000) for forming a shapeable and directable composite beam (305) from a plurality of pixel beams (302). The apparatus (800) includes a front-end unit (810) which communicates element signals through antenna array elements (808). The apparatus (800) also includes a back-end unit (850) which forms the composite beam from a set of pixel beams by converting between a composite signal and a set of corresponding pixel signals. The back-end unit (850) further adjusts the amplitude and phase of the set of pixel signals to form the composite beam. The apparatus (800) further includes an interconnecting beamforming network (820) interposed between the back-end unit (850) and the front-end unit (810) which couples the back-end unit (850) to the front-end unit (810) by converting between the pixel signals of the back-end unit (850) and the element signals of the front-end unit (810). The method (1100) includes determining a desired shape and direction for the composite beam (1110). The method (1100) then selects a set of pixel beams (1120) with which to form the composite beam. The method (1100) converts between the composite signal and a set of pixel signals corresponding to the set of pixel beams (1140). The method forms the composite beam (1150) by adjusting the amplitude and phase of the set of pixel signals.

27 Claims, 8 Drawing Sheets

400

| Beam ID | Directivity (dBi) | 3-beam over Gai | HPBW (degrees) | Side Lobe (dB down) | Amplitude Weight | Phase (degrees) |
|---|---|---|---|---|---|---|
| | 420 | 422 | 424 | 426 | 405 | 410 |
| A | 44.39 | 41.58 | 1.034 | -27.3 | 0.999 | 0.0 |
| B | 44.38 | 41.56 | 1.034 | -27.4 | 0.005 | 180.0 |
| C | 44.37 | 41.56 | 1.034 | -27.1 | 0.001 | 0.0 |
| D | 44.37 | 41.56 | 1.034 | -27.2 | 0.004 | 0.0 |
| E | 44.38 | 41.58 | 1.034 | -27.2 | 0.467 | 180.0 |
| F | 44.39 | 41.58 | 1.034 | -27.3 | 1.000 | 0.0 |
| G | 44.38 | 41.58 | 1.034 | -27.2 | 0.463 | 180.0 |
| Composite | 43.09 | 40.93 | 1.183 | -35.0 | | |

600

| Beam ID | Directivity (dBi) | 3-beam over Gai | HPBW (degrees) | Side Lobe (dB down) | Amplitude Weight (605) | Phase (degrees) (610) |
|---|---|---|---|---|---|---|
| A | 44.39 | 41.58 | 1.034 | -27.3 | 0.831 | 0.0 |
| B | 44.38 | 41.56 | 1.034 | -27.4 | 0.144 | 180.0 |
| C | 44.37 | 41.56 | 1.034 | -27.1 | 0.980 | 0.0 |
| D | 44.37 | 41.56 | 1.034 | -27.2 | 1.000 | 180.0 |
| E | 44.38 | 41.58 | 1.034 | -27.2 | 0.068 | 180.0 |
| F | 44.39 | 41.58 | 1.034 | -27.3 | 0.123 | 0.0 |
| G | 44.38 | 41.58 | 1.034 | -27.2 | 0.125 | 0.0 |
| Composite | 43.13 | 40.72 | 1.186 | -32.1 | | |

ENHANCED DIRECT RADIATING ARRAY

CROSS-REFERENCE TO RELATED APPLICATIONS

This application is related to Ser. No. 09/289,414, filed Apr. 4, 1999, titled "Multiple Scanning Beam Direct Radiating Array and Method for Its Use", which is incorporated herein by reference in its entirety, which is now U.S. Pat. No. 6,005,515.

BACKGROUND OF THE INVENTION

The present invention relates generally to antenna systems. More specifically, the present invention relates to an improved method and apparatus for providing a shapeable and directable communication beam.

In satellite communication systems, it is desirable to shape and direct communication beams. The ability to shape and direct communication beams results in efficient use of the finite energy resources of communication satellites, increases communication bandwidth, and reduces interference between beams.

In addition, there is a corresponding increase in communication security. Communicating only with an intended geographical area substantially complicates message interception from geographical areas outside the intended area of communication.

In the past, satellite-based phased array antenna systems were developed that provided bandwidth to communication areas using spot beams (communication beams designed to cover specific areas or "spots" on the Earth's surface). Typically the spot beams were organized into a matrix of evenly shaped and spaced beams (also referred to as pixel beams) designed to provide a total coverage to a large geographical area, such as a state, a nation, or the Earth.

The spot beams were generated using conventional phased array antenna systems. In conventional phased array antenna systems, each radiating antenna element in the array has a corresponding independent radio-frequency (RF) phase shifting circuit for each spot beam produced. Thus, for example, in a communication system incorporating a phased array antenna system with 547 elements, 547 corresponding RF phase shifters determine the shape and direction of a single spot beam.

Because of the complexity associated with determining and implementing the large number of RF phase shifts associated with a single spot beam, communication systems typically fixed the shape and direction of the spot beams to predetermined values. The satellite communication system communicates with users in a spot beam area with a corresponding spot beam signal and communicates with users in another spot beam area with another corresponding spot beam signal.

Fixed spot beam communication systems suffer from beam shaping inflexibility. For a fixed spot beam communication system to provide communication bandwidth to an area, the system must provide communication bandwidth to each spot beam area containing a portion of the area. For example, if a desired area includes subsections of three spot beam areas, the system must provide communication bandwidth to the three entire spot beam areas, including the subsections of the three spot beam areas not included in the desired communication area.

Fixed spot beam communication systems also suffer from beam directing inflexibility. A fixed spot beam communication system provides maximum beam gain at the center of each spot beam. Thus, users near the perimeter of spot beam areas receive lower quality communication service than users near the center of spot beam areas. For example, if a desired communication area is centered between three spot beam areas, the system provides maximum quality coverage to the communication area by using all three corresponding spot beams. Unfortunately, in the attempt to provide high quality coverage to the communication area, the system also provides relatively large amounts of communication energy to the centers of the three spot beam areas where the communication energy is not needed or wanted.

A need has long existed for a method and apparatus for forming a shapeable and directable communication beam.

SUMMARY OF THE INVENTION

Accordingly, it is an object of the present invention to provide a method and apparatus for forming a shapeable and directable communication beam.

It is also an object of the present invention to provide a method and apparatus for combining pixel beams to form a shapeable and directable composite beam.

It is a further object of the present invention to provide a method and apparatus for forming a composite beam from pixel beams at intermediate frequencies.

It is a yet further object of the present invention to provide an enhanced direct radiating array antenna system which forms shapeable and directable composite beams.

One or more of the foregoing objects is met in whole or in part by a preferred embodiment of the present invention that provides an improved method and apparatus for forming a shapeable and directable composite beam. The apparatus comprises an enhanced direct radiating array antenna system including a front-end unit, which communicates element signals through corresponding elements of a phased array antenna. The front-end unit includes IF/RF converters to convert between IF element signals and RF element signals.

The apparatus also includes a back-end unit that forms a composite beam from a set of pixel beams by converting between a composite signal and a set of corresponding pixel signals. The back-end unit includes a combiner/splitter which combines the set of pixel signals to form the composite signal or splits the composite signal into the set of pixel signals depending on whether the composite signal is received or transmitted respectively. The back-end unit further includes an amplitude and phase adjusting network which adjusts the phase and amplitude of at least one pixel signal of the set of pixel signals.

The apparatus further includes an interconnecting beamforming network which couples the front-end unit and the back-end unit. The interconnecting beamforming network converts between the pixel signals of the back-end unit and the element signals of the front-end unit.

The method includes determining a desired shape and direction for the composite beam. The method then selects a set of pixel beams with which to form the composite beam. The method further includes converting between a composite signal for communication over the composite beam and a set of pixel signals corresponding to the set of pixel beams. The method determines a set of phase and amplitude adjustments to make to the set of pixel signals. The method then forms the composite beam by performing the set of phase and amplitude adjustments on the set of pixel signals.

DETAILED DESCRIPTION OF THE PREFERRED EMBODIMENT

Figure 1:
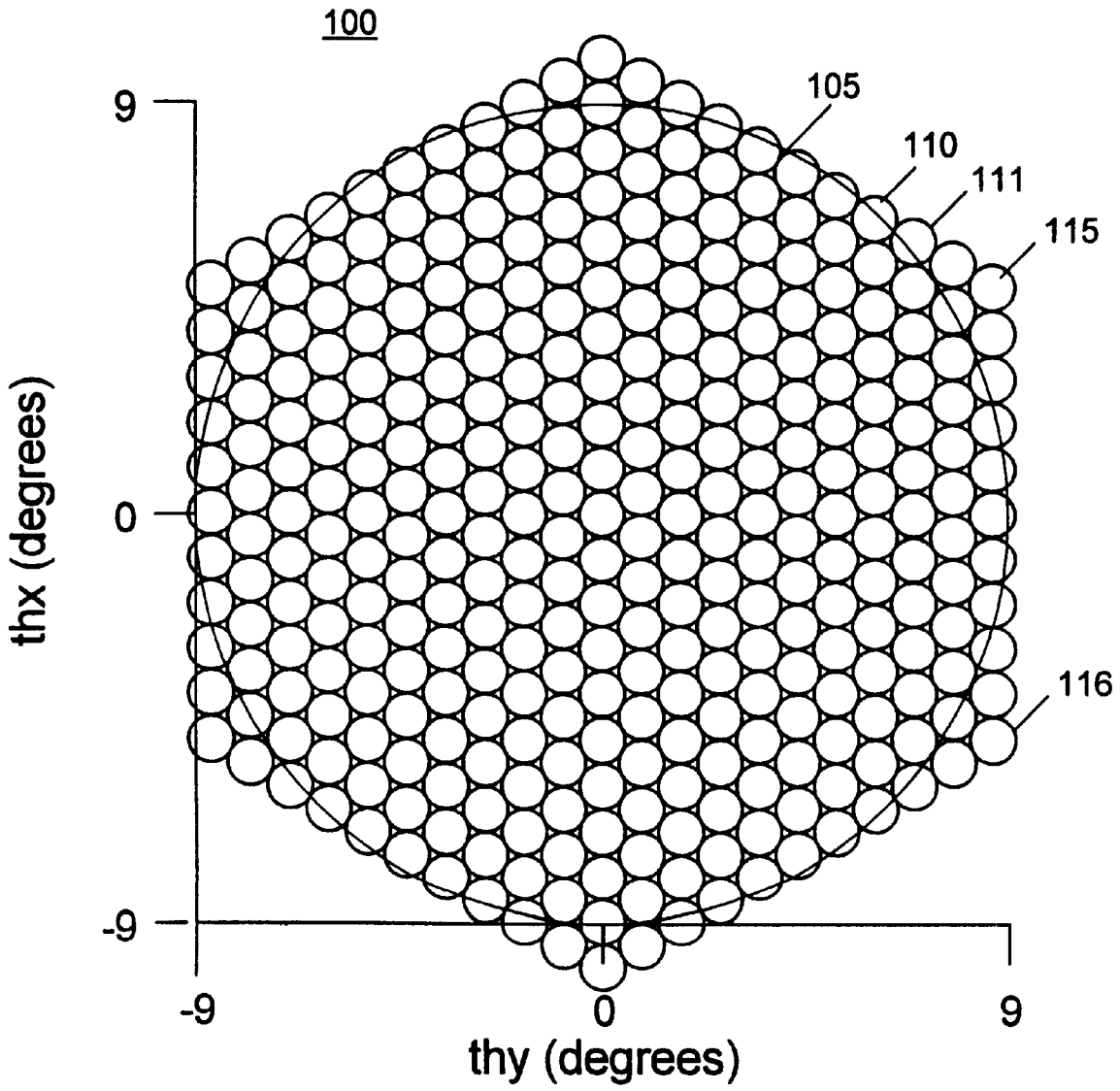
FIG. 1 shows an example Earth field of view covered with a hexagonal array of pixel beams.

Referring first to FIG. 1, that figure illustrates a hexagonal array 100 of pixel beams (e.g., small spot beams) positioned to cover a large coverage area. In particular, FIG. 1 illustrates a far field view of the Earth 105 from geosynchronous Earth orbit. From geosynchronous Earth orbit, approximately 313 one-degree pixel beams, such as the pixel beams 110 and 111, cover the far field view of the Earth 105. Note that because of the shape of the hexagonal array 100 of pixel beams, some of the pixel beams, such as the pixel beams 115 and 116, may cover areas just outside of the far field of view of the Earth 105.

Figure 2:
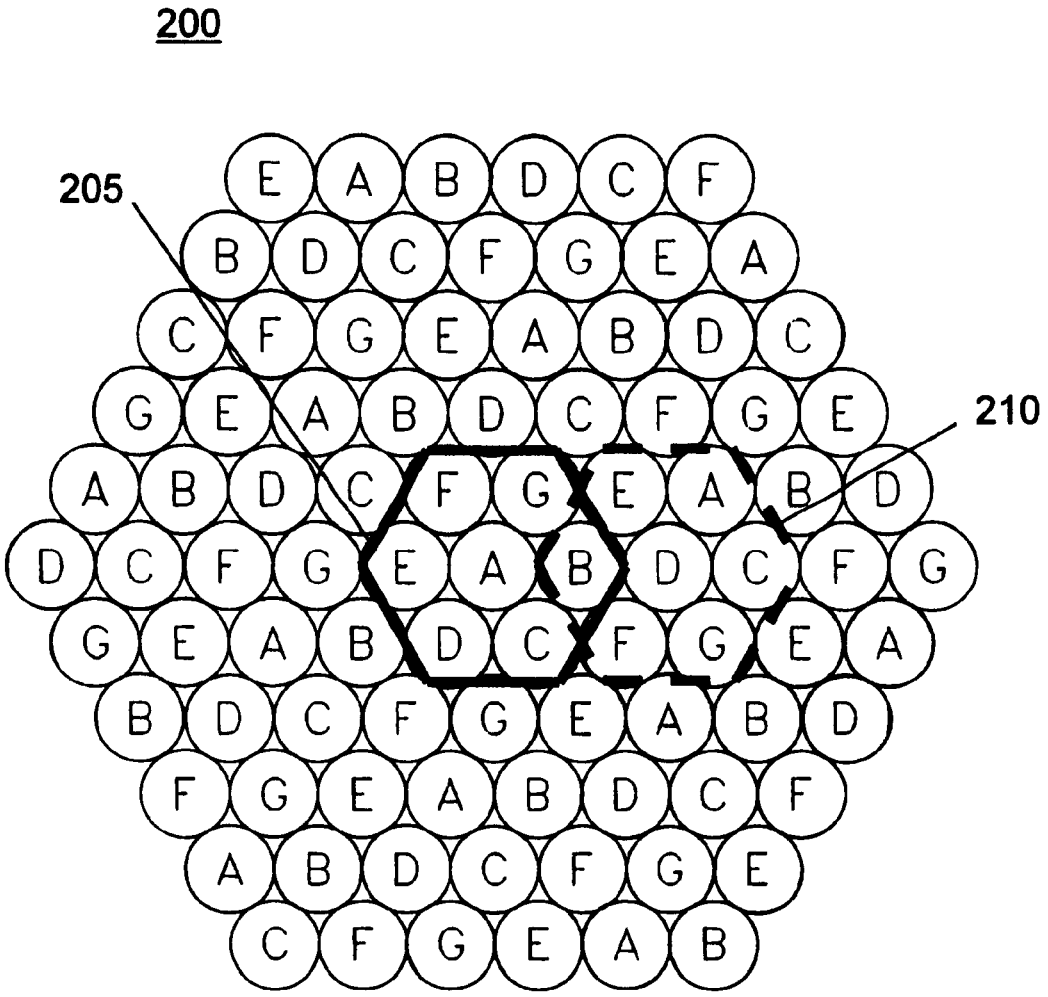
FIG. 2 illustrates example selections of a group of seven contiguous pixel beams.

Referring now to FIG. 2, that figure illustrates a hexagonal array 200 of pixel beams. The hexagonal array 200 is divided into seven groups, denoted by labels A–G. The seven groups may, for example, represent seven different frequency bands in a cellular satellite communication system. FIG. 2 illustrates two sets 205, 210 of seven pixel beams. For the example illustrated in FIG. 2, the sets 205, 210 include seven contiguous pixel beams, one from each of the seven groups A–G.

By grouping sets of pixel beams, such as those denoted by 205 and 210, the present communication system may perform a coarse directing of a composite beam. For example, a composite beam formed by the first set of pixel beams 205 may be coarsely directed toward the center pixel beam of the first set of pixel beams 205 (the A pixel beam). Likewise, a composite beam formed by the second set of pixel beams 210 may be coarsely directed to the center pixel beam of the second set of pixel beams 210 (the D pixel beam).

Note, however, that the resolution of composite beam directing by pixel beam grouping is limited to the angular width of a single pixel beam. For example, the present communication system may not move the pointing direction of the composite beam formed from the first set of pixel beams 205 one-half pixel to the right solely by selecting a different grouping of seven pixel beams.

Figures 3, 4:
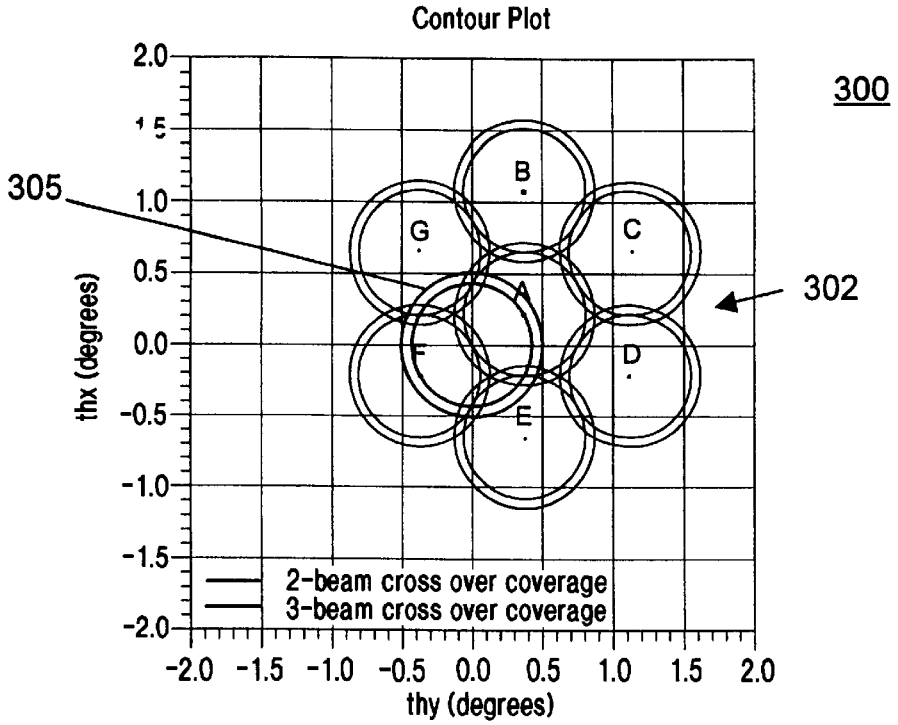
FIG. 3 illustrates a composite beam formed using a 7-way combining technique.
FIG. 4 shows a table with pixel signal amplitude and phase adjustments resulting in the composite beam illustrated in FIG. 3.

Referring now to FIG. 3, that figure illustrates an example composite beam formation 300. A composite beam 305 is formed from a group of seven pixel beams 302, denoted individually by labels A–G. Note however that the composite beam 305 does not encompass the total area covered by the group 302, nor is the center of the composite beam 305 directed to the center pixel beam A of the group 302. By adjusting the amplitude and phase of the signals (pixel signals) communicated over the pixel beams 302, the present invention provides the ability to finely shape and direct the composite beam 305.

FIG. 4 shows a table 400 including amplitude weighting 405 and phase shifting 410 values for the pixel beams 302 that form the composite beam 305. Note that the amplitude weights 0.005, 0.001 and 0.004 for the three pixel beams, B, C and D respectively, are relatively small. Conversely, the amplitude weights 0.999 and 1.000 of the dominant pixel beams, A and F respectively, are relatively large. Also note that the 180° phase shifts for the two pixel beams, G and E, help to restrain the coverage area of the composite beam 305 substantially to the area over the dominant pixel beams A and F.

It is noted that the values of the amplitude weighting factors 405 and the phase shift values 410 which provide the best fit for the desired shape and direction of the composite beam are preferably obtained by running an antenna optimization program. The optimization program may, for example, use a set of basis functions equal in number the set of pixel beams to arrive at a predetermined set of amplitude weighting factors 405 and phase shift values 410. The composite beam 305 may therefore be freely shaped and directed.

The table 400 of FIG. 4 also shows several beam characteristics for each of the pixel beams 302 and the composite beam 305. The beam characteristics include the directivity 420 of each of the beams and the 3-beam crossover gain 422 (the deepest gain point at the center of 3 adjacent beams). The beam characteristics also include the half-power beam width (HPBW) 424, which is the angular width of the beam measured between the half-power points on opposite sides of the beam. In addition, the beam characteristics include the difference in gain 426 between the respective main lobes of the beams and the respective side lobes.

Figures 5, 6:
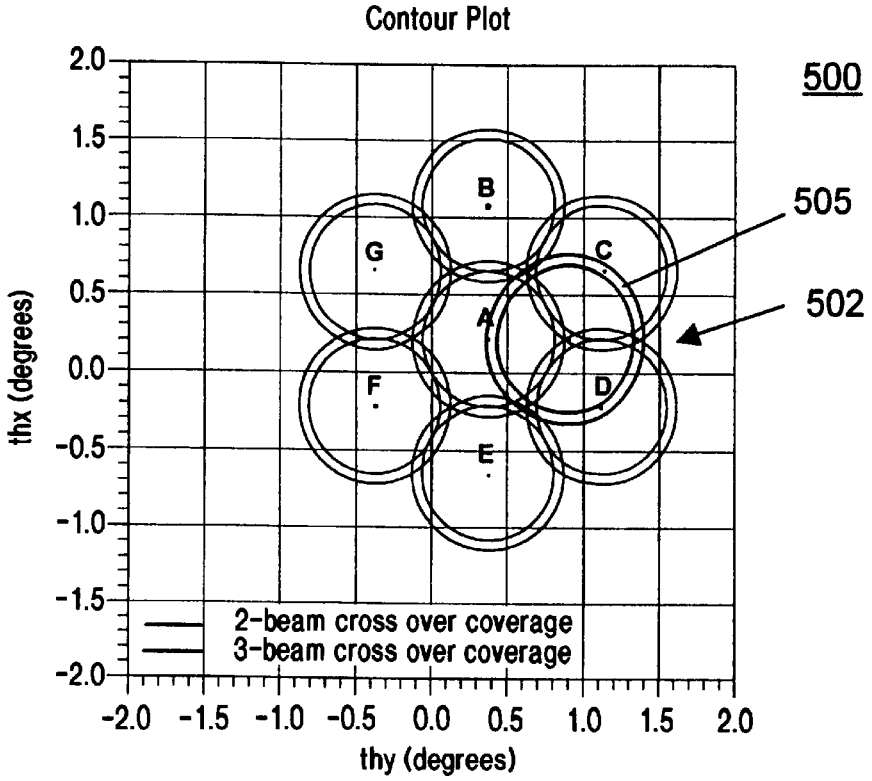
FIG. 5 illustrates a second composite beam formed using a 7-way combining technique.
FIG. 6 shows a table with pixel signal amplitude and phase adjustments resulting in the second composite beam illustrated in FIG. 5.

Turning now to FIG. 5, that figure illustrates the formation 500 of a second exemplary composite beam 505 using the seven pixel beams 502, denoted individually by labels A–G. In contrast to the composite beam 305 from the first example, the composite beam 505 in FIG. 5 is centered between three dominant pixel beams, A, C and D.

FIG. 6 shows a table 600 including amplitude weighting 605 and phase shifting values 610 for the pixel beams 502 that form the composite beam 505. Note that the amplitude weights 0.144, 0.068, 0.123 and 0.125 for the four pixel beams, B, E, F and G, respectively, are relatively small. Conversely, the amplitude weights 0.831, 0.980 and 1.000 for the dominant pixel beams, A, C and D respectively, are relatively large. As above, the table 600 provides the beam characteristics for the pixel beams 502 and the composite beam 505.

Figure 7:
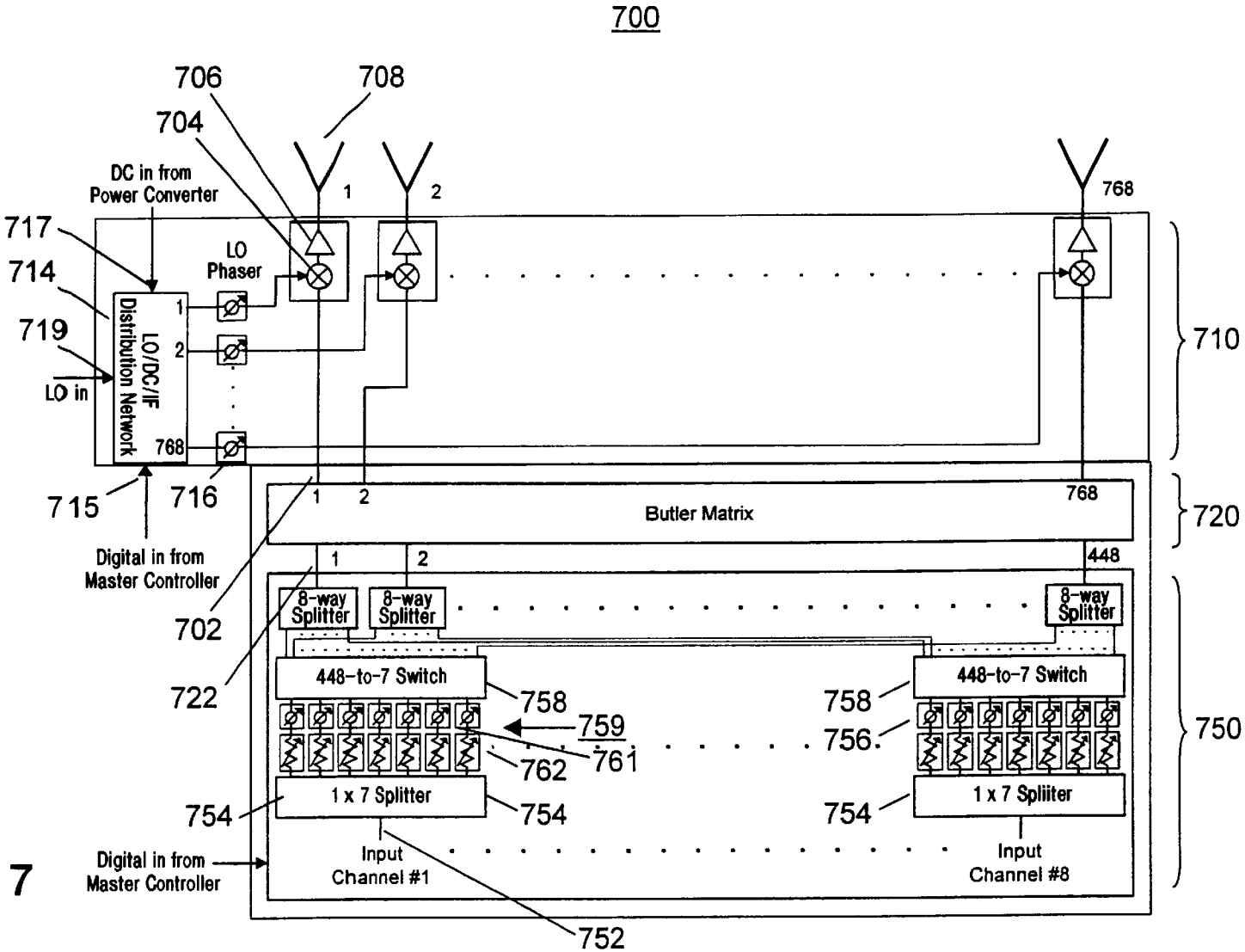
FIG. 7 shows a block diagram for an enhanced direct radiating array (EDRA) in a transmitting configuration.

Referring now to FIG. 7, that figure shows a block diagram for an enhanced direct radiating array (EDRA) 700. The EDRA 700 is configured to perform a transmitting function, and thus will also be referred to as the transmit EDRA 700.

The transmit EDRA 700 includes a front-end unit 710 for transmitting signals (hereinafter referred to as element signals) through respective antenna array elements 708. The front-end unit 710 includes element signal inputs (one of which is denoted by label 702) coupled to the IF side of respective IF/RF converters (hereinafter "upconverters") (one of which is denoted by label 704). The front-end unit 710 also includes solid-state power amplifiers (SSPAs) (one of which is denoted by label 706) coupled to the RF side of the respective upconverters 704. The SSPAs 706, in turn, drive respective antenna array elements (one of which is denoted by label 708).

The front-end unit 710 also includes a local oscillator/DC power/intermediate frequency (LO/DC/IF) distribution board 714 with oscillator outputs preferably equal in number to the upconverters 704. Local oscillator (LO) phasers 716, equal in number to the upconverters 704, couple the oscillator outputs of the local oscillator distribution board 714 to respective upconverters 704.

The front-end unit 710 receives element signals at the element signal inputs 702. The element signals are typically intermediate frequency (IF) signals. The upconverters 704 receive the element signals from the respective element signal inputs 702. The upconverters 704 also receive phase-adjusted LO signals from the respective LO phasers 716. The upconverters 704 use the phase-adjusted LO signals to convert the received IF element signals to radio frequency (RF) element signals. The upconverters 704 then output the RF element signals to the SSPAs 706 for amplification and transmission through the antenna array elements 708.

The LO/DC/IF distribution board 714 receives control signals from a master controller at input 715. The LO/DC/IF distribution board 714 also receives a DC power signal from a power supply at input 717. The LO/DC/IF distribution board 714 further receives a local oscillator signal from a local oscillator at input 719. The LO/DC/IF distribution board 714 distributes the control signals, DC power, and local oscillator signal to components of the front-end unit 710. The LO/DC/IF distribution board 714 outputs duplicates of the input local oscillator signal to the LO phasers 716.

The LO phasers 716 receive the LO signals output from the LO/DC/IF distribution board 714 and adjust the phases of the LO signals. This phase adjustment may be used for calibration and synchronization of element signals output through the various antenna array elements 708. The LO phasers 716 output the phase-adjusted LO signals to the respective upconverters 704. The upconverters 704, in turn, use the phase-adjusted LO signals to convert the received IF element signals to radio frequency (RF) element signals. The upconverters 704 then output the RF element signals to the corresponding SSPAs 706.

The EDRA 700 also includes an interconnecting beamforming network 720 interposed between the back-end unit 750 and the front-end unit 710. The interconnecting beamforming network 720 may comprise a pixel to element signal conversion matrix, such as, for example, a Butler Matrix, a Blass Matrix Network, or a Rotman Lens Network. The interconnecting beamforming network 720 typically includes an interconnected network of phase shifters and time delay elements and converts between pixel signals (on the back-end unit 750 side) and element signals (on the front-end unit 710 side). The interconnecting beamforming network 720 includes pixel signal interconnect ports (one of which is denoted by label 722) coupled to the back-end unit 750 and element signal interconnect ports 702 coupled to the front-end unit 710. The interconnecting beamforming network 720, as illustrated, converts between 448 pixel signals and 768 element signals.

Additional details on the front-end unit 710 and the interconnecting network 720 may be found in U.S. patent application Ser. No. 09/289,414, filed Apr. 4, 1999, titled "Multiple Scanning Beam Direct Radiating Array and Method for Its Use", which is incorporated herein by reference in its entirety.

The EDRA 700 also includes a back-end unit 750 (also referred to as the beam forming unit 750) for forming shapeable and directable composite beams for composite signals. The back-end unit 750 includes communication channel ports 752 coupled to corresponding signal splitters 754. The signal splitters 754 are also coupled to respective variable amplitude and phase networks 756. A switching network 758 couples the variable amplitude and phase networks 756 to the pixel signal ports 722 of the interconnecting beamforming network 720.

The back-end unit 750 receives input composite signals through the communication channel inputs 752. The composite signals input to the back-end unit 750 are the signals to be communicated over corresponding shapeable and directable composite beams.

The signal splitters 754 receive the composite signals from the respective communication signal inputs 752. The signal splitters 754 split the composite signals into sets of intermediate signals equal in number to the maximum number of pixel beams used to form a composite beam. For the EDRA 700 illustrated in FIG. 7, the maximum number of pixel beams used to form a communication beam is seven. Thus, the signal splitters 754 split the composite signals into sets of seven intermediate signals.

The variable amplitude and phase networks 756 receive the sets of intermediate signals from their respective signal splitters 754. The variable amplitude and phase networks 756 adjust the amplitude and phase of the intermediate signals to create pixel signal components for each of the pixel beams used to form the composite beam. The variable amplitude and phase networks 756 may, for example, include arrays of variable amplitude and phase devices (VAPs). One VAP is denoted by label 759. Each VAP 759 may, in turn, include a phase shifter 761 and a variable attenuator 762.

The switching network 758 receives the pixel signal components from the variable amplitude and phase networks 756 and routes the pixel signal components to the appropriate pixel signal ports 722 of the interconnecting beamforming network 720. For the EDRA 700 embodiment illustrated in FIG. 7, the composite beam is formed from at most one of each of seven groups of pixel beams A–G, as illustrated in FIGS. 2, 3 and 5. The switching network 758 couples the variable amplitude and phase networks 756 to the interconnecting matrix 720 by routing each of the seven intermediate signals from the variable amplitude and phase networks to a unique pixel beam type A–G. For example, for a variable amplitude and phase network 756 including an array of VAPs, the switching network 758 couples an intermediate signal from one VAP of the array of VAPs to a set of type A pixel beams, another intermediate signal from another VAP of the array of VAPS to a set of type B pixel beams, and so forth. The EDRA 700 is extendable to provide composite beam formation using any number of pixel beams in the system.

A composite signal traces a particular path through the EDRA 700. For example, a signal flows from the input channel #1 of the EDRA 700 through the splitter 754 corresponding to input channel #1 (where the signal is split into a set of seven intermediate signals). The corresponding variable amplitude and phase network 756 receives the intermediate signals and adjusts the amplitudes and phases of the intermediate signals to form as many as seven pixel signal components corresponding to the pixel beam types A–G. The switching network 758 then routes the pixel signal components to the appropriate pixel signal interconnect ports 722 of the interconnecting beamforming network 720.

The interconnecting beamforming network 720 converts the pixel signal components to a corresponding set of antenna array element signals. The interconnecting matrix 720 outputs the corresponding set of element signals to the front-end unit 710 through the element signal interconnect ports 724.

The front-end unit 710 receives the set of element signals at the corresponding set of element signal ports 702. The upconverters 704 corresponding to the set of element signal ports convert the set of IF element signals received from the interconnecting network 720 to a set of RF element signals. The corresponding SSPAs 706 subsequently amplify the set of RF element signals and transmit the set of RF element signals through the corresponding antenna array elements 708.

Figure 8:
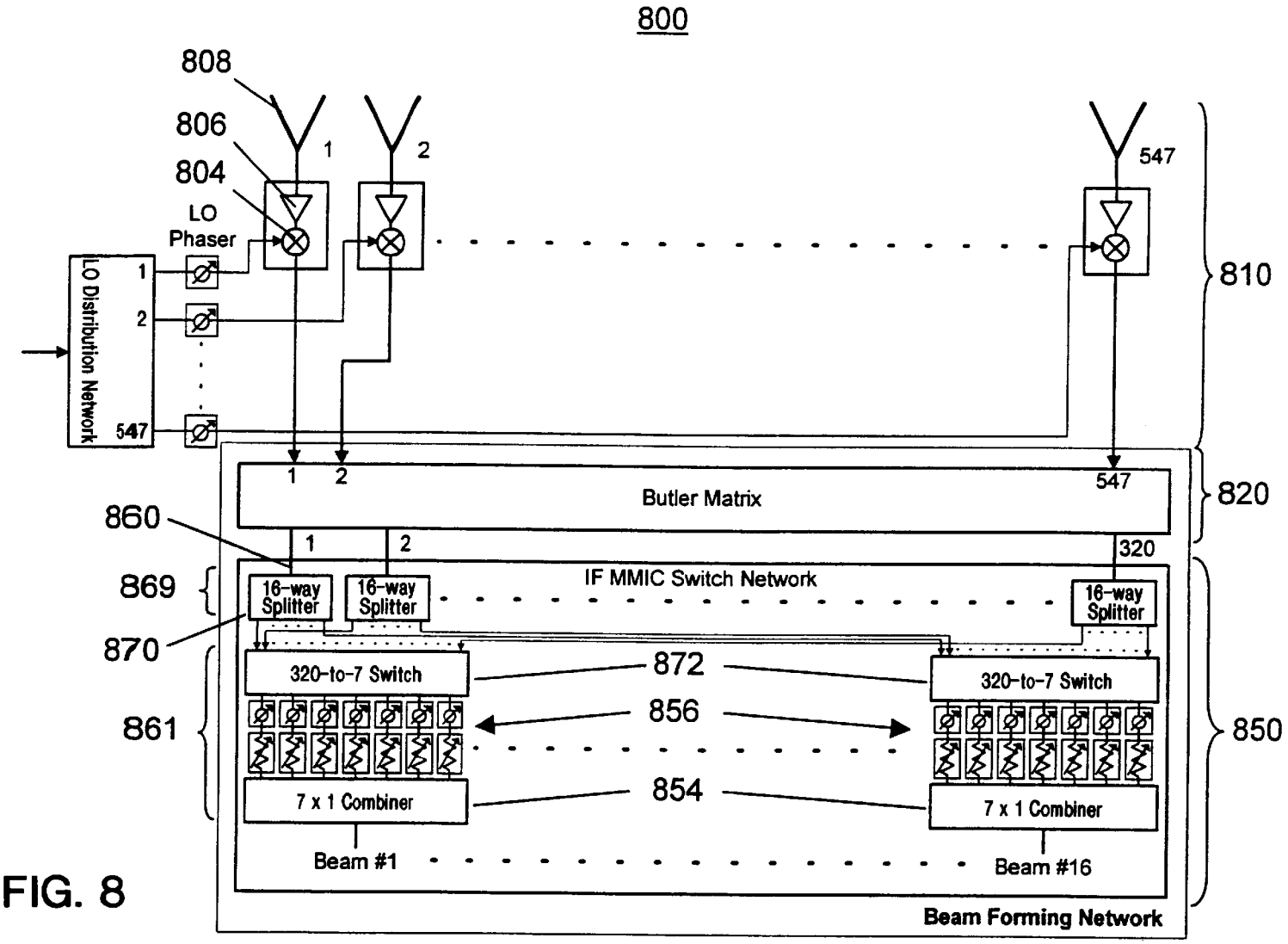
FIG. 8 shows a block diagram for an EDRA in a receiving configuration.

Referring now to FIG. 8, that figure shows a block diagram for an EDRA 800 in a receiving configuration (hereinafter "receive EDRA 800") according to an embodiment of the present invention. The receive EDRA 800 is similar to the transmit EDRA 700 illustrated in FIG. 7.

One general difference, however, lies in the number of antenna array elements, pixel beams, and communication beams and channels. The transmit EDRA 700 illustrated 8 communication channels, 448 pixel beams and 768 antenna array elements. The receive EDRA 800 is shown with 16 communication channels, 320 pixel beams and 547 antenna array elements. The exact number of communication channels, pixel beams, and array elements may be varied to meet the needs of any particular antenna system.

The receive EDRA 800 includes a front-end unit 810 similar to the front-end unit 710 of the transmit EDRA 700. The front-end unit 810 of the receive EDRA 800, however, includes low noise amplifiers (LNAs) (one of which is denoted by label 806) in place of the SSPAs 706 of the transmit EDRA 700. The front-end unit 810 of the receive EDRA 800 also includes downconverters (one of which is denoted by label 804) in place of the upconverters 704 of the transmit EDRA 700.

The front-end unit 810 receives RF element signals through the antenna array elements 808. The LNAs 806 receive the RF element signals from their respective antenna array elements 808 and amplify the RF element signals. The downconverters 804 convert the amplified RF element signals from the LNAs 806 to IF element signals. The front-end unit 810 then outputs the IF element signals to the interconnecting beamforming network 820.

The interconnecting beamforming network 820 for the receiving EDRA 800 is similar to the interconnecting beamforming network 720 for the transmitting EDRA 700. The interconnecting beamforming matrix 820 converts the 547 element signals received from the front-end unit 810 to 320 pixel signals.

The back-end unit receives the 320 pixel signals from the interconnecting beamforming matrix 820 and converts the 320 pixel signals to as many as sixteen composite signals.

The back-end unit 850 includes pixel signal input ports (one of which is denoted by label 860) coupled to a signal splitting network 869, which may include, for example, a set of 320 16-way splitters (one of which is denoted by label 870). The back-end unit 850 also includes a set of sixteen pixel signal switches 872, which may be 320-to-7 switches, coupled to the signal splitting network 869. The back-end unit 850 further includes a set of variable amplitude and phase networks 856, which may include arrays of seven variable amplitude and phase devices (VAPs), interposed between the 320-to-7 switches 872 and a corresponding set of sixteen 7×1 combiners 854.

The back-end unit 850 receives pixel signals from the interconnecting beamforming network 820 on the 320 pixel signal input ports 860. The 16-way splitters 870 split each of the received pixel signals sixteen ways and provide one of the sixteen split received pixel signals to each of the sixteen 320-to-7 switches 872. This enables each of the sixteen communication channels of the back-end unit 850 to access pixel signals from any of the 320 pixel beams.

Each of the sixteen 320-to-7 switches 872 corresponds to a unique one of the sixteen communication channels. For the receive EDRA 800 illustrated in FIG. 8, each of the 16 composite beams, corresponding to the 16 communication channels, may be formed from as many as seven of the 320 pixel beams. Accordingly, each of the 320-to-7 switches 872 pass up to seven of the 320 pixel signals to the corresponding variable amplitude and phase networks 856.

The variable amplitude and phase networks 856 provide the capability to modify the amplitude and phase of each of the pixel signals passed by the respective 320-to-7 switches. The variable amplitude and phase networks 856 output the tuned pixel signals, any number of which may be modified in amplitude and phase, to the corresponding 7×1 combiners 854.

The 7×1 combiners 854 combine the tuned pixel signals received from the variable amplitude and phase networks 856 to form composite signals. The combination of a 320-to-7 switch 872, a variable amplitude and phase network 856, and a 7×1 combiner 854 (each corresponding to a single communication channel) may be referred to, in aggregate, as a beam forming unit 861.

Figure 9:
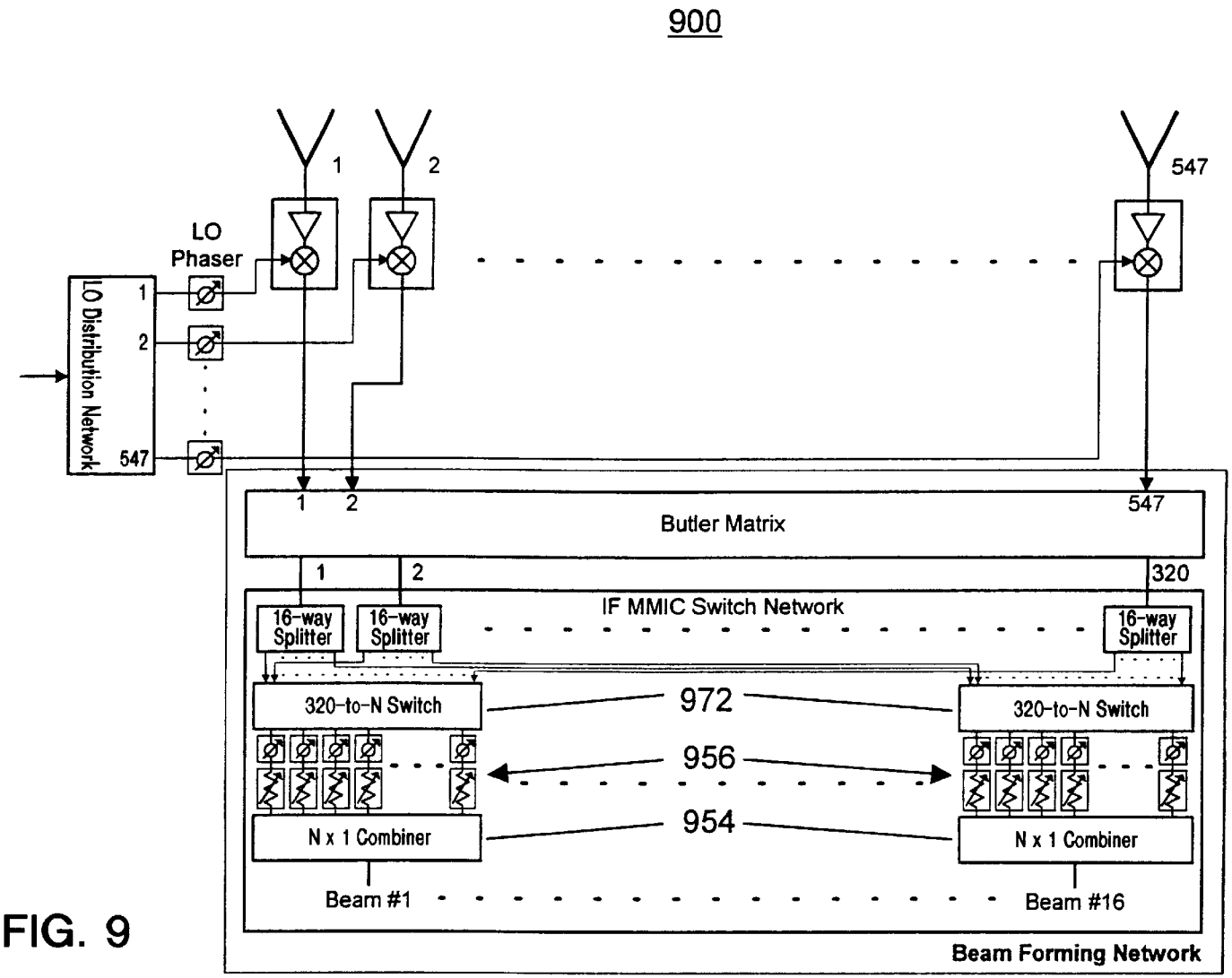
FIG. 9 shows a block diagram for an EDRA in a receiving configuration that combines up to N pixel beams to form a composite beam.

The receive EDRA 800 may be extended to form communication beams from any number of the total number of pixel beams in the system. Referring to FIG. 9, that figure illustrates an extended EDRA 900 in a receive mode which is capable of forming sixteen composite beams, each composite beam formed from as many as N pixel beams.

The extended EDRA 900 includes 320-to-N switches 972 in place of the 320-to-7 switches 872 in the receive EDRA 800. The 320-to-N switches 972 provide the capability to select as many as N of the 320 pixel beams to form each composite beam. A variable amplitude and phase network 956, which may include arrays of N VAPs, receives the selected pixel signals from the 320-to-N switches 972 and adjusts the amplitude and phase of the selected pixel signals according to the desired shape and direction of the corresponding composite beam.

The extended EDRA 900 also includes N×1 combiners 954 in place of the 7×1 combiners 854 in the receive EDRA 800. The N×1 combiners 954 combine the tuned pixel signals from the corresponding variable amplitude and phase devices 956 to form the corresponding composite signals.

Figure 10:
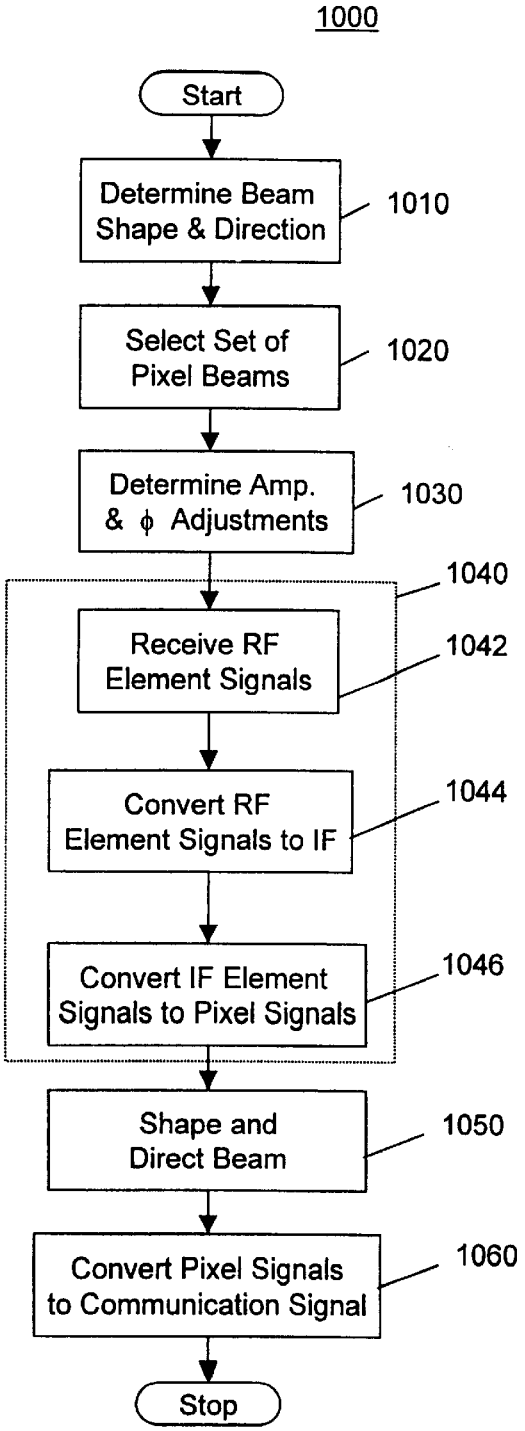
FIG. 10 illustrates a method for forming a shapeable and directable receive composite beam from numerous of pixel beams.

Referring now to FIG. 10, that figure illustrates a method 1000 for forming a shapeable and directable receive composite beam from numerous pixel beams. The method includes determining the desired shape and direction for the receive composite beam at step 1010. The method, at step 1020, then selects an appropriate set of pixel beams with which to form the composite beam.

At step 1030, the method determines amplitude and phase adjustments to be applied to pixel signals received over the set of pixel beams to form the composite beam. Step 1030 may include executing an optimization computer program which generates the amplitude and phase adjustments.

The method receives, at step 1040, the set of pixel signals corresponding to the set of pixel beams selected in step 1020. The pixel beam receiving step 1040 may, for example, include a substep 1042 for receiving RF element signals corresponding to the set of pixel signals, a substep 1044 for converting the RF element signals to IF element signals, and a substep 1046 for converting the IF element signals to the set of pixel signals.

Once the method receives the set of pixel signals, the method shapes and directs the composite beam at step 1050 by adjusting the amplitude and phase of the set of pixel signals according to the amplitude and phase adjustments determined in step 1030. Lastly, at step 1060, the method converts the set of pixel signals adjusted at step 1050 into a composite signal by combining the set of pixel signals.

Figure 11:
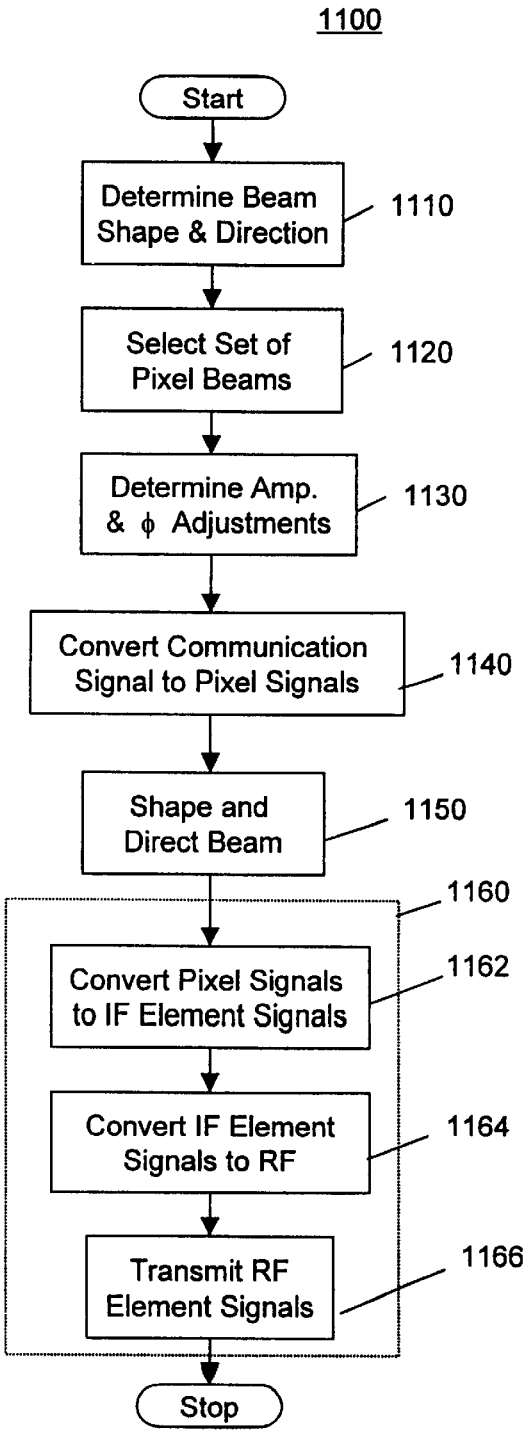
FIG. 11 illustrates a method for forming a shapeable and directable transmit composite beam from numerous of pixel beams.

Referring now to FIG. 11, that figure illustrates a method 1100 for forming a shapeable and directable transmit composite beam from numerous pixel beams. The method 1100 is generally similar to the receive composite beamforming method 1000 illustrated in FIG. 10.

The method includes determining the desired shape and direction for the transmit composite beam at step 1110. The method, at step 1120, then selects an appropriate set of pixel beams with which to form the composite beam.

At step 1130, the method determines amplitude and phase adjustments to make to pixel signals to be transmitted over the set of pixel beams to form the composite beam. Step 1130 may include, for example, executing an optimization computer program which generates the amplitude and phase adjustments.

The method divides the composite communication signal into a set of pixel signals at step 1140. The method then shapes and directs the composite beam at step 1150 by adjusting the amplitude and phase of the set of pixel signals according to the amplitude and phase adjustments determined in step 1130.

The method then transmits the set of amplitude and phase adjusted pixel signals at step 1160. The transmitting step 1160 may, for example, include a substep 1162 for converting the pixel signals into a corresponding set of IF element signals, a substep 1164 for converting the set of IF element signals into a set of RF element signals, and a substep 1166 for transmitting the set of RF element signals.

The present invention thereby provides an improved method and apparatus for forming a shapeable and directable composite beam from numerous pixel beams. The present invention offers advantages of improved energy efficiency, reduction in noise, increased communication rate and increased security. The improvement in energy efficiency stems from reductions in energy used to transmit signal energy to unwanted regions in an effort to reach all wanted regions. The reduction in noise stems from a reduction in signal energy transmitted to and received from unwanted regions. The reduction in noise, in turn, leads to corresponding increases in communication data rates, reductions in data error rates, and further increases in energy efficiency.

While particular elements, embodiments and applications of the present invention have been shown and described, it will be understood that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A direct radiating array antenna system for forming a composite beam from a set of pixel beams, comprising:

a back-end unit comprising a communication channel port, a variable amplitude and phase network coupled to said communication channel port, and a switching network coupled to said variable amplitude and phase network, said switching network including a plurality of pixel beam ports;

a front-end unit comprising a plurality of antenna array elements coupled to a plurality of antenna element signal ports; and an interconnecting beamforming network interposed between said back-end unit and said front-end unit, said interconnecting beamforming network comprising a plurality of pixel signal interconnect ports coupled to said pixel beam ports and a plurality of element signal interconnect ports coupled to said antenna element signal ports.

2. The antenna system of claim 1, wherein said back-end unit and said interconnecting network operate at intermediate frequencies, and wherein said front-end unit comprises an IF/RF converter with an IF side and a RF side, the IF side coupled to said interconnecting beamforming network, and the RF side coupled to said antenna array elements.

3. The antenna system of claim 1, wherein a corresponding set of pixel signals are communicated over the set of pixel beams, and wherein said variable amplitude and phase network comprises a plurality of attenuators and phase shifters that adjust the amplitude and phase of the corresponding set of pixel signals.

4. The antenna system of claim 1, wherein the composite beam comprises a receive composite beam, N pixel beams are used to form the receive composite beam, and said back-end unit comprises:

a pixel signal switch coupled between said interconnecting beamforming network and said variable amplitude and phase network, which passes N pixel signals corresponding to the N pixel beams from said interconnecting beamforming network to said variable amplitude and phase network; and a combiner coupled between said variable amplitude and phase network and said communication channel port which combines signals received from said variable amplitude and phase network to form a composite signal corresponding to the receive composite beam.

5. The antenna system of claim 1, wherein the composite beam comprises a receive composite beam, N of a total of T pixel beams are used to form the receive composite beam, and said back-end unit comprises:

a T-to-N switch coupled to said interconnecting beamforming network which passes N corresponding pixel signals from the N pixel beams;

N variable amplitude and phase devices coupled to the N outputs of said T-to-N switch, said N variable amplitude and phase devices outputting N corresponding tuned pixel signals; and an N-to-1 combiner coupled to said N variable amplitude and phase devices that combines the N corresponding tuned pixel signals to form a composite signal corresponding to the receive composite beam.

6. The antenna system of claim 1, wherein the antenna system forms R receive composite beams, N of a total of T pixel beams are used to form each of the R receive composite beams, and wherein said back-end unit comprises:

T R-way splitters coupled to T pixel signal interconnect ports of said interconnecting beamforming network; and R beam forming units corresponding to the R receive composite beams, each of said R beam forming units coupled to said T R-way splitters such that each of said R beam forming units is coupled to pixel signals corresponding to each of the T pixel signal interconnect ports, each of said R beam forming units comprising:

a T-to-N switch which selects N pixel signals from the N pixel beams corresponding to the respective receive composite beam;

N variable amplitude and phase devices coupled to said T-to-N switch which generate N tuned pixel signals by adjusting amplitude and phase of the N pixel signals corresponding to the respective receive composite beam; and an N-to-1 combiner coupled to said N variable amplitude and phase devices which combines the N tuned pixel signals to form a composite signal corresponding to the respective receive composite beam.

7. The antenna system of claim 1, wherein said interconnecting beamforming network comprises a Butler matrix.

8. The antenna system of claim 1, wherein said front-end unit comprises Y antenna array elements corresponding to Y element signal interconnect ports of said interconnecting beamforming network, and said front-end unit further comprises Y RF-to-IF converters corresponding to said Y antenna array elements, said Y RF-to-IF converters interposed between respective ones of the Y element signal interconnect ports of said interconnecting beamforming network and respective ones of said Y antenna array elements.

9. The antenna system of claim 8, wherein said front-end unit further comprises:

a local oscillator distribution network for generating Y local oscillator signals corresponding to said Y antenna array elements;

Y local oscillator phasers corresponding to said Y antenna array elements and coupled to said local oscillator distribution network for outputting Y phase-adjusted local oscillator signals corresponding to said Y antenna elements; and Y element signal mixers corresponding to said Y antenna array elements and coupled to said Y local oscillator phasers, the Y element signal interconnect ports of said interconnecting beamforming network, and said Y antenna array elements, each of said Y element signal mixers converting the corresponding RF element signal from the respective one of said Y antenna array elements and the corresponding phase-adjusted local oscillator signal to an IF element signal output to the corresponding element signal interconnect port of said interconnecting beamforming network.

10. The antenna system of claim 1, wherein the composite beam comprises a transmit composite beam, N pixel beams are used to form the transmit composite beam, and said back-end unit comprises a splitter interposed between said communication channel port and said amplitude and phase adjusting network, said splitter receiving a composite signal from said communication channel port and outputting N pixel component signals to said amplitude and phase adjusting network.

11. The system of claim 1, wherein the composite beam comprises a transmit composite beam, N of a total of T pixel beams are used to form the transmit composite beam, and said back-end unit comprises:

a 1-to-N splitter coupled to said communication channel port for outputting N pixel component signals from a composite signal received from said communication channel port;

N variable amplitude and phase devices coupled to said 1-to-N splitter which generate N tuned pixel component signals by adjusting amplitude and phase of the N pixel component signals; and an N-to-T switching network coupled to said N variable amplitude and phase devices and said interconnecting beamforming network that routes the N tuned pixel component signals to N corresponding pixel signal interconnect ports of said interconnecting beamforming network.

12. The antenna system of claim 1, wherein the antenna system forms X transmit composite beams, N of a total of T pixel beams are used to form each of the X transmit composite beams, and said back-end unit comprises:

a switching network coupled to said interconnecting beamforming network, said switching network comprising T X-to-1 pixel signal forming combiners which provide each of T pixel signal interconnect ports of said interconnecting beamforming network with composite pixel signals; and X beam forming units corresponding to the X transmit composite beams, each of said X beam forming units coupled to said switching network, each of said X beam forming units comprising:

a 1-to-N splitter for outputting N pixel component signals from a composite signal to be transmitted over the respective transmit composite beam;

N variable amplitude and phase devices coupled to said 1-to-N splitter which generate N tuned pixel component signals by adjusting the amplitude and phase of the N pixel component signals, each of the N tuned pixel component signals corresponding to one of the T pixel beams; and an N-to-T switching network coupled to said N variable amplitude and phase devices and each of said T X-to-1 pixel signal forming combiners, said N-to-T switching network coupling the N tuned pixel component signals to the respective X-to-1 pixel signal forming combiners.

13. The antenna system of claim 12, wherein said interconnecting beamforming network comprises a Butler matrix.

14. The antenna system of claim 12, wherein said antenna array elements comprise Y antenna array elements corresponding to Y element signal interconnect ports of said interconnecting beamforming network, and said front-end unit further comprises Y IF-to-RF converters corresponding to said Y antenna array elements, said Y IF-to-RF converters interposed between respective ones of the Y element signal interconnect ports of said interconnecting beamforming network and respective ones of said Y antenna array elements.

15. The system of claim 14, wherein said front-end unit further comprises:

a local oscillator distribution network for generating Y local oscillator signals corresponding to said Y antenna array elements;

Y local oscillator phasers corresponding to said Y antenna array elements and coupled to said local oscillator distribution network for outputting Y phase-adjusted local oscillator signals corresponding to said Y antenna array elements; and Y element signal mixers corresponding to said Y antenna array elements and coupled to said Y local oscillator phasers, the Y element signal interconnect ports of said interconnecting beamforming network, and said Y antenna array elements, each of said Y element signal mixers converting the corresponding IF element signal from said interconnecting beamforming network and the corresponding phase-adjusted local oscillator signal to an element signal output to the corresponding one of said Y antenna array elements.

16. A method for forming a composite beam from pixel beams, the method comprising:

determining desired composite beam characteristics for a composite beam, the composite beam characteristics comprising at least one of beam shape and direction;

selecting a set of pixel beams for forming the composite beam according to the desired composite beam characteristics;

converting between a composite signal corresponding to the composite beam and a set of pixel signals corresponding to the set of pixel beams; and forming the composite beam by adjusting amplitude and phase of at least one pixel signal of the set of pixel signals.

17. The method of claim 16, wherein forming the composite beam comprises:

determining a set of amplitude and phase adjustments for the set of pixel signals to form the composite beam according to the desired composite beam characteristics; and adjusting the set of pixel signals according to the set of amplitude and phase adjustments.

18. The method of claim 17, wherein determining a set of amplitude and phase adjustments comprises executing an optimization program to determine the set of amplitude and phase adjustments.

19. The method of claim 16, further comprising communicating the set of pixel signals, said communicating comprising:

converting between the set of pixel signals and a set of element signals corresponding to a set of antenna array elements; and communicating the set of element signals.

20. The method of claim 19, wherein the set of element signals are IF element signals, and wherein said step of communicating the set of pixel signals further comprises converting between the set of IF element signals and a corresponding set of RF element signals.

21. The method of claim 16, wherein converting between a composite signal and a set of pixel signals comprises converting between an IF composite signal and a set of IF pixel signals.

22. The method of claim 16, wherein the composite beam is a receive composite beam, and wherein:

said forming the composite beam comprises adjusting the amplitude and phase of at least one of the set of pixel signals, to create a set of tuned pixel signals; and said converting comprises combining the set of tuned pixel signals to form the composite signal.

23. The method of claim 22, further comprising communicating the set of pixel signals, said communicating comprising:

receiving a set of RF element signals corresponding to a set of antenna array elements;

converting the set of RF element signals to a set of IF element signals; and converting the set of IF element signals to the set of pixel signals.

24. The method of claim 23, wherein converting the set of IF element signals to the set of pixel signals comprises:

converting the set of IF element signals to a set of IF pixel signals using a beamforming matrix; and selecting the set of pixel signals from the set of IF pixel signals.

25. The method of claim 16, wherein the composite beam is a transmit composite beam, and wherein:

converting between a composite signal and a set of pixel signals comprises splitting the composite signal into the set of pixel signals; and forming the composite beam comprises adjusting the amplitude and phase of at least one pixel signal of the set of pixel signals.

26. The method of claim 25, further comprising transmitting the set of pixel signals, comprising:

converting the set of pixel signals to a set of IF element signals corresponding to a set of antenna array elements;

converting the set of IF element signals to a set of RF element signals; and transmitting the RF element signals through the set of antenna array elements.

27. The method of claim 26, wherein converting the set of pixel signals to a set of IF element signals comprises converting the set of pixel signals to the set of IF element signals using a pixel/element conversion matrix.

* * * * *